US008152276B2

(12) United States Patent
Murayama et al.

(10) Patent No.: US 8,152,276 B2
(45) Date of Patent: Apr. 10, 2012

(54) LIQUID JET HEAD, METHOD FOR MANUFACTURING LIQUID JET HEAD, AND METHOD FOR FORMING STRUCTURE FOR LIQUID JET HEAD

(75) Inventors: Hiroyuki Murayama, Kawasaki (JP); Yoshinori Tagawa, Yokohama (JP); Souta Takeuchi, Yokohama (JP); Makoto Watanabe, Yokohama (JP); Keiji Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 518 days.

(21) Appl. No.: 12/357,820

(22) Filed: Jan. 22, 2009

(65) Prior Publication Data

US 2009/0191487 A1 Jul. 30, 2009

(30) Foreign Application Priority Data

Jan. 28, 2008 (JP) ..... 2008-016369
Sep. 24, 2008 (JP) ..... 2008-244196

(51) Int. Cl.
*B41J 2/14* (2006.01)

(52) U.S. Cl. ..... 347/47

(58) Field of Classification Search ..... 347/20, 347/40, 45, 47
See application file for complete search history.

(56) References Cited

U.S. PATENT DOCUMENTS

| | | | |
|---|---|---|---|
| 7,287,847 | B2 | 10/2007 | Fujii et al. |
| 7,300,596 | B2 | 11/2007 | Murayama et al. |
| 7,475,966 | B2 | 1/2009 | Fujii et al. |
| 2003/0048328 | A1 | 3/2003 | Inamoto et al. |
| 2007/0176990 | A1 | 8/2007 | Urayama et al. |
| 2007/0178248 | A1 | 8/2007 | Ohsumi et al. |
| 2007/0207414 | A1 | 9/2007 | Murayama et al. |
| 2009/0133256 | A1 | 5/2009 | Okano et al. |
| 2009/0136875 | A1 | 5/2009 | Kubota et al. |
| 2009/0225136 | A1 | 9/2009 | Fujii et al. |
| 2009/0229125 | A1 | 9/2009 | Kato et al. |

FOREIGN PATENT DOCUMENTS

| | | | |
|---|---|---|---|
| CN | 1270891 | A | 10/2000 |
| CN | 1486848 | A | 4/2004 |
| CN | 1880080 | A | 12/2006 |
| JP | 2003-080717 | | 3/2003 |
| JP | 2007-261169 | | 10/2007 |

*Primary Examiner* — An Do
(74) *Attorney, Agent, or Firm* — Fitzpatrick, Cella, Harper & Scinto

(57) ABSTRACT

A liquid ejecting head includes a coating resin layer including a plurality of ejection outlets for ejecting liquid and flow paths which are in fluid communication with the ejection outlets, respectively; a substrate having energy generating elements for generating energy for ejecting liquid; and an adhesion improving layer provided between the coating resin layer and the substrate. The coating resin layer further includes a first resin material layer closest to the substrate and at least one second resin material layer, and the first resin material layer provides at least one stepped portion continuing from a periphery of the second resin material layer.

9 Claims, 14 Drawing Sheets

LIQUID JET HEAD, METHOD FOR MANUFACTURING LIQUID JET HEAD, AND METHOD FOR FORMING STRUCTURE FOR LIQUID JET HEAD

FIELD OF THE INVENTION AND RELATED ART

The present invention relates to a liquid jet head which records by ejecting liquid toward recording medium. In particular, it relates to an ink jet recording head which records by ejecting ink. Further, it relates to a method for forming microscopic structural components usable for manufacturing semiconductors or the like.

There have been disclosed various liquid jet heads of the so-called side shooter type, that is, liquid jet heads which jet ink droplets in the direction perpendicular to the substrate of a liquid jet head (Japanese Laid-open Patent Application 2007-261169).

FIG. 6 is a schematic perspective view of an example of a liquid jet head of the conventional side-shooter type. Incidentally, for simplification, FIG. 6 schematically shows a substantially smaller number of liquid ejection outlets 106 and energy generating elements 101 that the actual number of liquid ejection outlets 106 and energy generating elements 101 of the liquid jet head.

As for the structure of this liquid jet head, this liquid jet head is made up of a substrate 102 and a resinous plate 103 having multiple liquid ejection outlets 106. The resinous plate 103 is bonded to the substrate 102. The substrate 102 has an ink distribution hole 107. The liquid jet head is also provided with multiple energy generating elements 101, which are disposed on the surface of the substrate 102, to which the resinous plate 103 is adhered, in such a manner that the energy generating elements align with the liquid ejection outlets 106, one for one. Bonding of the resin plate 103 to the substrate 102 creates multiple ink passages which extend from the ink distribution hole 107 to the ink ejection outlets 106, which are above the abovementioned energy generating elements, one for one. Ink is supplied to each ink passage 108 through the ink distribution hole 107, is jetted out of the ink ejection outlet 106 by the bubble generated by the function of the energy generating element, and adheres to recording medium.

In the case of a liquid jet head structured like the liquid jet head described above, the resinous plate 103, that is, a resin layer formed in a manner to cover the substrate 102, has its inward portion provided with liquid ejection outlets 106 and ink passages 108. Therefore, the inward portion of the resinous plate 103, in terms of the direction parallel to the primary surfaces of the substrate 102, is less in physical volume than its outward portion. That is, the outward portion of the resinous plate 103 is greater in physical volume than the inward portion of the resinous plate 103.

In comparison, in the case of the liquid jet head disclosed in Japanese Laid-open Patent Application 2003-080717, its peripheral portion (outward portion) of the resin plate (layer) is made thinner than its center portion (inward portion), and therefore, the outward portion of the resinous layer is less in physical volume than its inward portion. Further, the thin peripheral portion of the resin layer of the ink jet head disclosed in the second patent document is provided with grooves. That is, these thin portions are separated by the grooves, and have vacant portions.

In recent years, demand has been increasing for ink jet printers which are substantially faster in printing speed than conventional ink jet printers. This demand for the increase in speed seems to come from the fact that there has been a significant increase in the processing speed of a computer, and also, that ink jet printers have been further reduced in the size of their already minute ink droplets, being therefore required to be higher in ink dot density (ink droplet density).

Further, in the field of printers capable of outputting a print of a large size, or printers connected to a network, the desire to increase the printers in output speed is even greater. There are two ways to increase a printer in output speed. One is to increase a printer in the number of ink droplets it can jet per unit length of time, that is, to increase a printer in the frequency with which it can jet ink droplets per unit length of time. The other is to increase a printer in the number of ink ejection outlets. Usually, both of the two methods are employed to increase a printer in output speed. However, increasing a printer in the number of ink ejection outlets results in the increase in the length of the liquid jet head of the printer.

In recent years, however, it has become evident, through various tests, that the longer the liquid jet head, the more likely the peripheral portions of the resin layer, of which the liquid passage plate of the liquid jet head is made, to separate from the substrate. More specifically, the portions of the resin layers, which are on the outward side relative to the liquid ejection outlets and ink passages, that is, the portions which are greater in volume, are greater in the amount of the stress to which they are subjected, than the portions of the resin layer, which have the liquid ejection outlets and liquid passages. Thus, the frequency and extent with which the outward portions separate from the substrate is greater than those with which the inward portions separate from the substrate. It also became evident that the thicker the liquid passage plate (resin layer) of a liquid jet head, the greater the amount of the stress to which the liquid passage plate (resin layer) is subjected, and therefore, the higher the frequency with which it separates from the substrate.

On the other hand, in the case of the liquid jet head disclosed in Japanese Laid-open Patent Application 2003-080717, the peripheral portions of the liquid passage plate (resin layer) are formed thinner than the other portions. However, it is rather difficult to control the manufacturing process for a liquid jet head so that the peripheral portions will have a specified thickness. Thus, under certain conditions, it was rather difficult to make liquid jet heads, the liquid passage plate (resin layer) of which is sufficiently thin across its peripheral portions. Therefore, even in the case of the liquid jet head made in accordance with this patent application, the separation of the liquid passage plate (resin layer) from the substrate sometimes occurred.

SUMMARY OF THE INVENTION

One of the objects of the present invention is to solve the above-described problem of a conventional liquid jet recording head. Thus, the primary object of the present invention is to provide a highly reliable liquid jet head by solving the problems which a conventional liquid jet recording head suffers, more specifically, the problem that the liquid passage plate (resin layer) of a liquid jet head separates from the substrate of the liquid jet head.

According to an aspect of the present invention, there is provided a liquid ejecting head and a structure therefor, a manufacturing method therefor, wherein said liquid ejecting head comprises a coating resin layer including a plurality of ejection outlets for ejecting liquid and flow paths which are in fluid communication with the ejection outlets, respectively; an energy generating element for generating energy for ejecting liquid; and an adhesion improving layer provided between said coating resin layer and said substrate, wherein said coating resin layer further includes a first resin material layer closest to said substrate and at least one second resin material layer, and said first resin material layer provides at least one stepped portion continuing from a periphery of said second resin material layer.

The present invention can prevent the liquid passage plate (resin layer) of a liquid jet head from separating from the substrate of the liquid jet head, and therefore, it can improve a liquid jet head in reliability. Further, the liquid jet head manufacturing method in accordance with the present invention can even more precisely form a liquid jet head which is highly reliable in that its liquid passage plate is unlikely to separate from its substrate.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be concretely described with reference to the appended drawings. It should be noted here that if a given component of the liquid jet head in any of the following embodiments of the present invention is the same in structure as any of the previously described components, the second component will be given the same referential number, and may not be described.

A liquid jet head in accordance with the present invention is mountable in a printer, a copying machine, a facsimile machine with a communication system, a word processor or the like apparatus with a printer portion, and also, an industrial recording apparatus which is in combination with various processing apparatuses. Further, a liquid jet head in accordance with the present invention can be used as an ink jet recording head to record on various recording media, for example, paper, thread, fiber, cloth, leather, metal, plastic, glass, lumber, ceramic, etc. Incidentally, not only does "recording" mean to form a meaningful image, such as a letter, a pattern having a specific meaning, but also, to form a meaningless image on recording medium.

Further, the present invention is compatible with a recording head of the so-called full-line type, which is wide enough to cover the entire recordable range of a sheet of recording medium, in terms of the direction perpendicular to the direction in which the sheet of recording medium is conveyed. Moreover, it is compatible with a large recording head made up of an integral combination of small recording heads, a color recording head made up of a combination of multiple, individually manufactured small recording heads.

Hereafter, the preferred embodiment of the present invention will be described with reference to the appended drawings.

Embodiment 1

Figure 1:
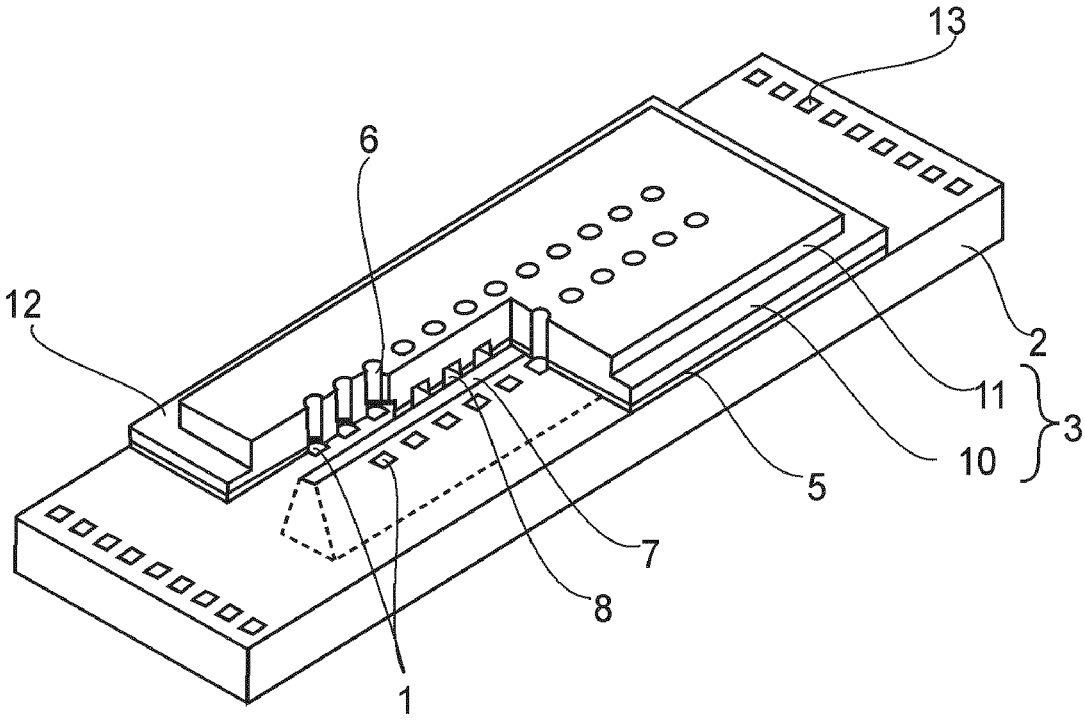
FIG. 1 is a schematic perspective view of the liquid jet head in the first embodiment of the present invention.

FIG. 1 is a schematic perspective view of the liquid jet head in this embodiment.

This liquid jet head is made up of a substrate 2, an ink passage plate 3, energy generating elements 1, contact pad 13. The energy generating elements 1 are disposed in two columns on the substrate 2, at a preset pitch. The contact pad 13 is for establishing electrical connection between the liquid jet head and the other devices, and is formed also on the substrate 2. The substrate 2 has an ink distribution hole 7, the top opening of which is between the two columns of energy generating elements. The ink passage plate 3 has two columns of ink ejection outlets 6, and multiple ink passages 8 which extend from the ink distribution hole 7 to the ink ejection outlets 6, one for one. The ink passage plate 3 hereafter may be referred to as a substrate covering resin layer 3, or simply as a resin layer 3. The ink passage plate 3 is bonded to the substrate 2 with the placement of an adhesion enhancement layer 5 between the ink passage plate 3 and substrate 2, in such a manner that the ink ejection outlets 6 align with the energy generating elements one for one.

Figure 2:
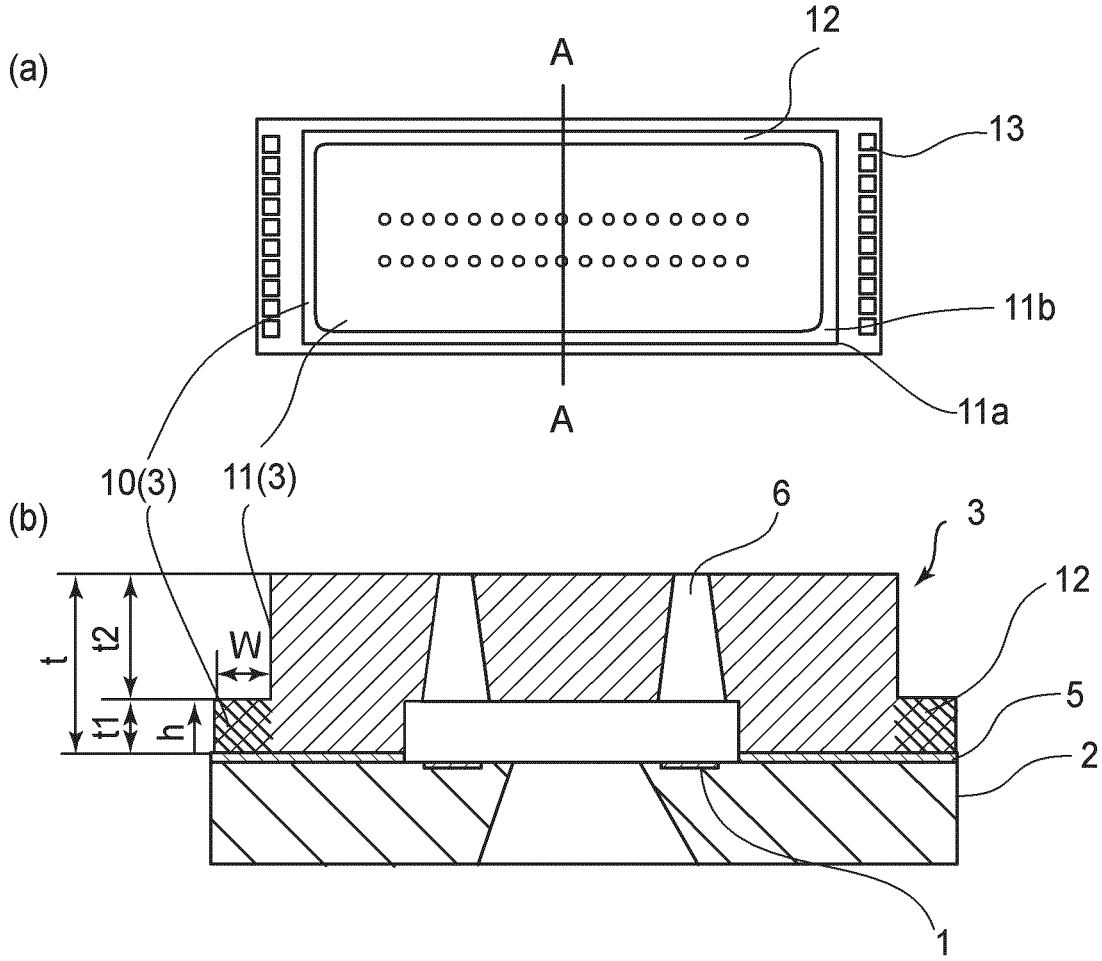
FIG. 2(*a*) is a plan view of the recording chip, which is a part of the liquid jet head in the first embodiment of the present invention, and FIG. 2(*b*) is a sectional view of the recording head.

FIG. 2(*a*) is a top plan view of the recording chip which is a part of the liquid jet head in this embodiment. FIG. 2(*b*) is a sectional view of the recording chip at a line A-A in FIG. 2(*a*).

As described above, the stress generated in the substrate covering resin layer 3 is affected by the thickness of the resin layer 3. That is, the greater the thickness of the resin layer 3, the greater the amount by which stress is generated in the resin layer 3. This stress sometimes causes the resin layer 3 to separate from the adhesion enhancement layer 5, and the separation adversely affects the liquid jet head in terms of reliability.

In this embodiment, therefore, the substrate covering resin layer 3 is separated into two sublayers, that is, a first resin layer 10 and a second resin layer 11, with the presence of a step 12. Next, this structural setup will be described in detail.

Referring to FIGS. 2(*a*) and 2(*b*), the liquid jet head in this embodiment has the substrate 2, first resin layer 10 formed on the substrate 2, and second resin layer 11 formed on the first resin layer 10. In other words, the second resin layer 11 is above the substrate 2 with the presence of the first resin layer 10 between the second resin layer 11 and substrate 2.

Further, the second resin layer 11 is made smaller than the first resin layer 10, creating therefore the step 12 between the top surface of the second resin layer 10 and the top surface of the first resin layer 11. That is, the location of the step 12 coincides with those of the bottom edges of the second resin layer 11. Referring to FIG. 2(*b*), the hatched portion 12, that is, a portion of the first resin layer 10, which horizontally extends beyond the bottom edges of the second resin layer 11, is solid. That is, the step portion 12 does not have grooves or the like. Further, the step portion 12 and second resin layer 11 are integral parts of the ink passage plate 3, that is, the substrate covering resin layer 3.

The amount by which stress is generated in the step portion 12 of the substrate covering resin layer 3 can be reduced by reducing the step portion 12 in thickness. Further, the step portion 12 is the portion of the first resin layer 10, which horizontally extends beyond the edge of the second resin layer 11, as described above. That is, there is a step between the first and second resin layers 10 and 11. In other words, the substrate covering resin layer 3 is provided with pliant portions, that is, the boundaries between the bottom edges of the second resin layer 11 and the first resin layer 10. Therefore, the stress generated in the peripheral portion of the substrate covering resin layer 3 can be dispersed into the abovementioned boundaries, and the boundary between the first resin layer 10 and adhesion enhancement layer 5. That is, the above-described structural arrangement can reduce the stress generated in the substrate covering resin layer 3. In other words, the present invention can afford more latitude in designing a liquid jet head in terms of the thickness of the first resin layer 10.

Further, the liquid jet head in this embodiment is structured so that the height h (thickness) of the step portion 12 from the interface between the adhesion enhancement layer 5 and substrate covering resin layer 3 is less than the half of the thickness t of the thickest portion of the substrate covering resin layer 3. The first resin layer 10 is in direct contact with the adhesion enhancement layer 5, and therefore, the volume of the first resin layer 10 significantly affects whether or not the first resin layer separates from the substrate 2 (adhesion enhancement layer 5). Thus, in order to minimize the amount by which stress is generated in the first resin layer 10 by reducing the first resin layer 10 in volume, the liquid jet head in this embodiment is structured so that the thickness t1 of the first resin layer 10 is no more than one half the thickness t of the substrate covering resin layer 3. Further, even though the liquid jet head is structured so that the step portion 12 is thin, the step portion 12 does not have grooves or the like; it is solid. Thus, the step portion 12 is satisfactorily strong.

As for the thickness t of the substrate covering resin layer 3 having the step portion 12, the thickness t is the sum of the thickness t1 of the first resin layer 10 and the thickness t2 of the second resin layer 11. That is, the provision of the step portion 12 divides the substrate covering resin layer 3, the thickness of which is t, into the portion which is t1 in thickness, and the portion which is t2 in thickness. Thus, the stress generated in the substrate covering resin layer 3 is distributed into the portion with the thickness of t1 and the portion with the thickness of t2, in proportion to the their thickness. Therefore, the amount by which stress is generated in the step portion 12, that is, the peripheral portion of the first resin layer 10, which is in contact with the adhesion enhancement layer 5, is relatively small because the step portion 12 is thin (t1 in thickness). Therefore, the step portion 12 is unlikely to separate from the substrate 2.

In this embodiment, the liquid jet head is structured so that the first resin layer 10 is thinner (t1 in thickness) than the second resin layer 11, as described above. Thus, the second resin layer 11 is relatively thick (t2 in thickness) compared to the first resin layer 10 (t1 in thickness). In order for an ink jet head to be satisfactory in ink ejecting performance, the distance between each of its liquid ejection outlets 6 and the corresponding energy generating element 1, that is, the thickness t of the substrate covering resin layer 3, has to be set to a specific value. In this embodiment, the thickness t of the substrate covering resin layer 3 is roughly 75 μm. Structuring a liquid jet head so that the thickness t2 of the second resin layer 11 is greater than the thickness t1 of the first resin layer 10 makes the second resin layer 11 greater than the first resin layer 10 in the amount by which stress is generated in them. If the amount of stress in the second resin layer 11 exceeds a certain value, the second resin layer 11 cracks. However, the cracks which occur in the second resin layer 11 are different from the cracks which occur at the interface between the substrate covering resin layer 3 and adhesion enhancement layer 5 as the substrate covering resin layer 3 separates from the substrate 2. That is, unlike the cracks which occur at the interface between the substrate covering resin layer 3 and adhesion enhancement layer 5, the cracks which occur in the substrate covering resin layer 3 are attributable to the cohesive failure of the substrate covering resin layer 3 itself.

Thus, in this embodiment, in order to prevent the occurrences of the cracking of the substrate covering resin layer 3, which is attributable to cohesive failure, the corner portions 11*b* of the second resin layer 11 are rounded to reduce the amount of the stress which concentrates to these portions.

However, the corner portions 11*a* of the first resin layer 10 are not rounded; a vertical surface of the first resin layer 10 (relative to substrate 2) perpendicularly intersects with its adjacent vertical surfaces. That is, in this embodiment, the four corners 11*a* of the first resin layer 10 have an angle 90°;

the vertical surfaces of the first resin layer 10 perpendicularly intersect with the adjacent vertical surfaces. If the corner portions 11*a* of the first resin layer 10 are rounded, the point to which stress concentrates is likely to shift from the first resin layer 10 to the adhesion enhancement layer 5, and therefore, the adhesion enhancement layer 5 and substrate 2 may separate from each other, or cohesive failure may occur to the adhesion enhancement layer 5. If the adhesion enhancement layer 5 separates from the substrate 2 or becomes damaged due to cohesive failure, the adhesion enhancement layer 5 fails to protect the surface of the substrate. This is why the corner portions 11*a* of the first resin layer 10 are angled at 90° to prevent the point to which stress concentrates, from shifting from the first resin layer 10 to the adhesion enhancement layer 5.

In this embodiment, the overall thickness t of the resin layer 3 is roughly 75 μm, and the thickness t1 of the first resin layer 10, which is a part of the substrate covering resin layer 3 is roughly 20 μm, whereas the width w of the step portion 12 is roughly 80 μm. Thus, even if the substrate covering resin layer 3 is changed in thickness, the same effects as those described above can be obtained by changing the second resin layer 11 in thickness (t2) and/or the step portion 12 in width w, as necessary.

Also in this embodiment, the substrate covering resin layer 3 is structured so that there is only one step between the main portion of the substrate covering resin layer 3 and the peripheral portion of the substrate covering resin layer 3. However, the substrate covering resin layer 3 may be structured so that there are two or more steps between the main portion of the substrate covering resin layer 3 and the peripheral portion of the substrate covering resin layer 3. That is, the substrate covering resin layer 3 may be structured so that there are two or more second resin layers 11 on the first resin layer 10. In a case where the substrate covering resin layer 3 is structured so that two or more second resin layers 11 are on the first resin layer 10, the main portion of the substrate covering resin layer 3 is surrounded by two or more step portions 12, which are different in thickness. For example, if the substrate covering resin layer 3 is structured so that there are two second resin layers 11 stacked on the first resin layer 10, the bottom second resin layer 11 is formed on the first resin layer 10 in such a manner that the peripheral area of the first resin layer 10 remains exposed from the bottom resin layer 11, and the top second resin layer 11 is formed on the bottom second resin layer 11 in such a manner that the peripheral area of the bottom second resin layer 11 remains exposed from the top second resin layer 11.

By structuring the substrate covering resin layer 3 so that there are two or more steps between the main portion (center portion in terms of plane parallel to substrate 2) of the substrate covering resin layer 3 and the outermost edge of the substrate covering resin layer 3, the stress generated at the step portions 12, that is, the peripheral portions of the resin layer 3, can be dispersed in steps into the two or more step portions 12; the stress can be further dispersed.

Next, referring to FIG. 3, a typical method for manufacturing the liquid jet head in accordance with the present invention will be described.

Figure 3:
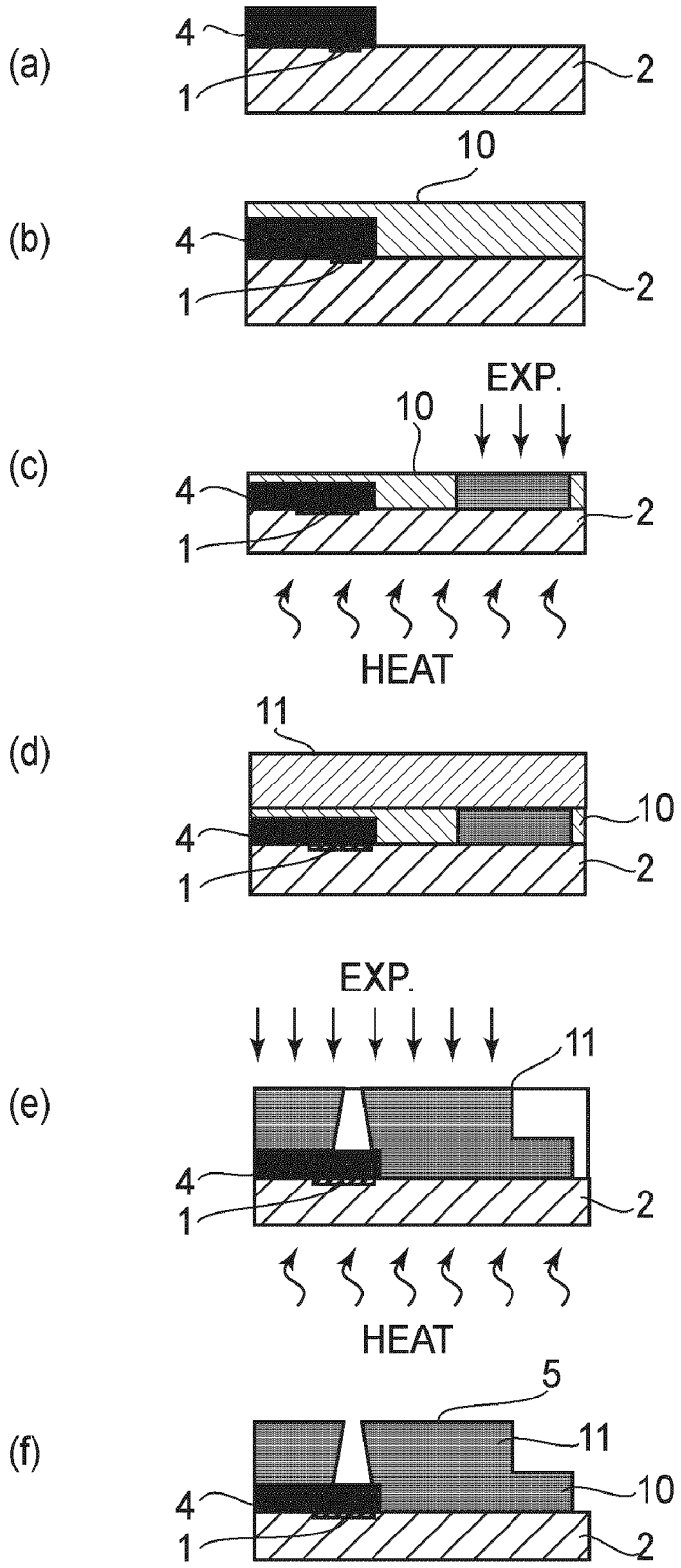
FIGS. 3(*a*)-3(*f*) are schematic drawings for describing the steps in a typical method for manufacturing the liquid jet head in accordance with the present invention.

First, referring to FIG. 3(*a*), a layer 4 is formed of dissolvable resin on the substrate 2 which already has the energy generating elements 1. The dissolvable resin layer 4 is formed in the pattern of the multiple ink passages 8. More concretely, first, a dry sheet of dissolvable resin is laminated to the substrate 2, and resist is coated on the laminated sheet of dissolvable resin by spin-coating or the like method. Then, the resist layer is exposed to ultraviolet rays (Deep-UV light), and developed. Even more concretely, polymethyl isopropenyl ketone (ODUR-1010: product of Tokyo Ohka Kogyo Co., Ltd.) is spin-coated on the substrate 2, and dried. Then, the dried polymethyl isopropenyl ketone is patterned by being exposed with the use of Deep-UV light, and developed.

Next, referring to FIG. 3(*b*), the first resin layer 10 is formed on the dissolvable resin layer 4.

Next, referring to FIG. 3(*c*), the first resin layer 10 is exposed with ultraviolet rays (Deep-UV light), for example. Then, the portion of the first resin layer 10, which will become the step portion 12, is heated to create the pattern of the step portion 12.

Then, the material for the second resin layer 11 is coated as shown in FIG. 3(*d*).

Next, the coated material for the second resin layer 11 is exposed with ultraviolet rays (Deep-UV light), for example, as shown in FIG. 3(*e*).

Lastly, the precursor of the liquid jet head formed through the above described steps is developed to form the first and second resin layers 10 and 11 as shown in FIG. 3(*f*).

As described above, the liquid jet head in this embodiment is provided with the step portion 12, that is, the portion of the first resin layer 10, which extends outward beyond the second resin layer 11. Therefore, it is unlikely to suffer from the problem that the peripheral portion of the substrate covering resin layer 3 separates from the substrate 2. Further, the step portion 12 is solid, being therefore satisfactorily strong.

Embodiment 2

Figure 4:
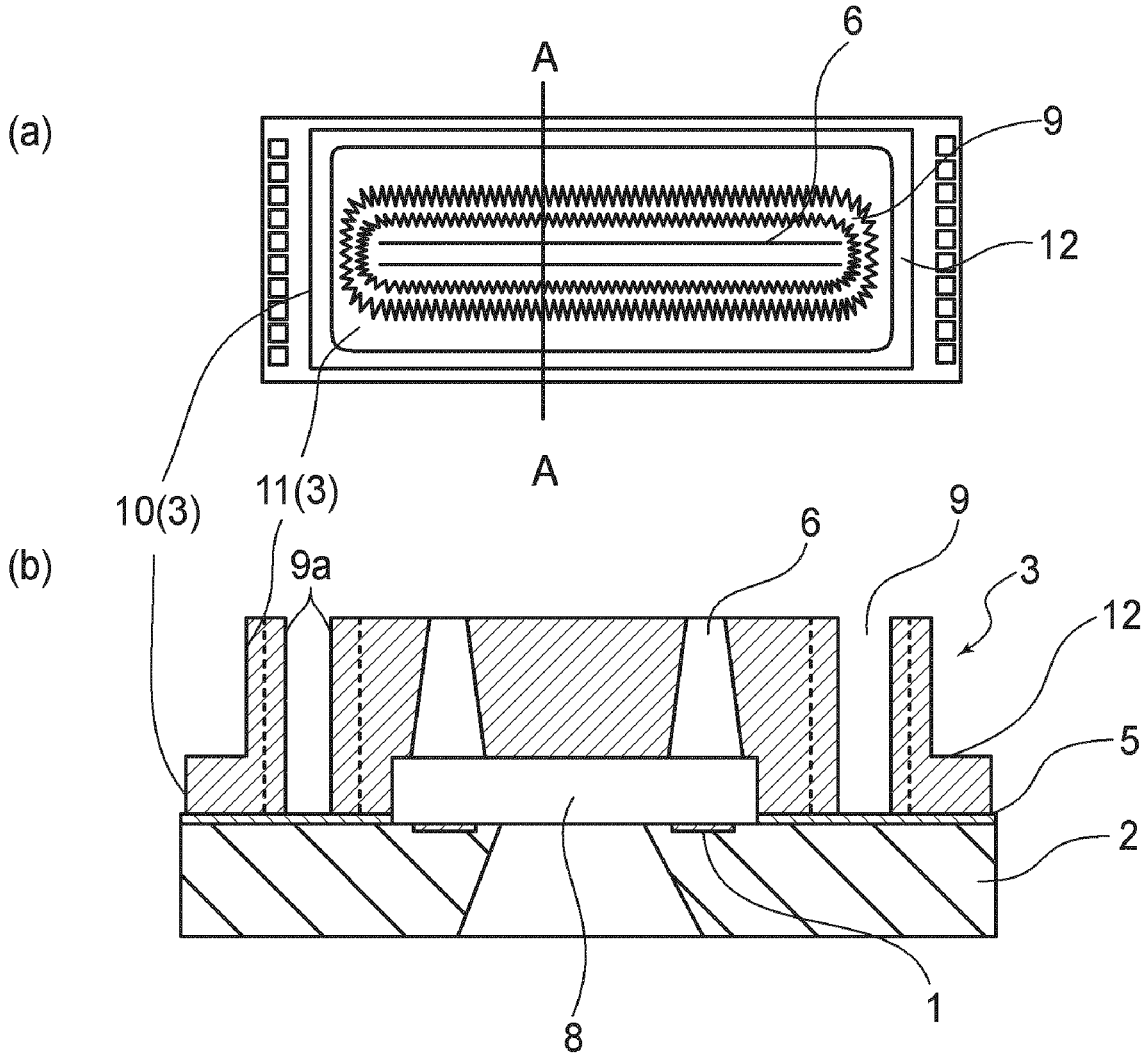
FIG. 4(*a*) is a plan view of the recording chip, which is a part of the liquid jet head in the second embodiment of the present invention, and FIG. 4(*b*) is a sectional view of the recording chip.

Next, referring to FIGS. 4(*a*) and 4(*b*), the second preferred embodiment of the present invention will be described. FIG. 4(*a*) is a top plan view of the recording chip, which is a part of the liquid jet head in this embodiment, and FIG. 4(*b*) is a sectional view of the recording chip, at a line A-A in FIG. 4(*a*).

In this embodiment, the second resin layer 11 is provided with a groove 9, which surrounds the ink passage portion having the liquid ejection outlets 6 and ink passages 8. The groove 9 is shaped so that the surface 9*a* of each of its two lateral walls is jagged; the cross section of the surface 9*a* of each of its lateral walls, at a plane perpendicular to the substrate 2, looks like saw teeth.

The structure of the liquid jet head in this embodiment is the same as that of the liquid jet head in the first embodiment, except that the second resin layer 11 of the latter has the groove 9. Thus, the features of the liquid jet head in this embodiment, which are the same as those of the liquid jet head in the first embodiment will not be described in detail. Further, the structural components of the liquid jet head in this embodiment, which are the same as the counterparts in the first embodiment will be given the same referential codes to describe them.

If the surface 9*a* of each of the lateral walls of the groove 9 is flat, the stress generated in the second resin layer 11 works in the same direction across a large area, and therefore, the separation of the substrate covering resin layer 3 from the adhesion enhancement layer 5 occurs across a large area of the interface between the substrate covering resin layer 3 and adhesion enhancement layer 5. In this embodiment, however, the surface 9*a* of each of the lateral surfaces of the groove 9 of the substrate covering resin layer 3 is made jagged so that its cross section, at a plane parallel to the substrate 3, looks like the teeth portion of a saw. Therefore, the stresses different in direction are generated in the same area of the interface between the second resin layer 11 and adhesion enhancement layer 5. Thus, some of the stresses cancel with each other, reducing therefore the stress which acts on the substrate covering resin layer 3. Further, since the second resin layer 11 of the liquid jet head in this embodiment is provided with the groove 9, the substrate covering resin layer 3 of the liquid jet head in this embodiment is smaller in overall volume than the liquid jet head in the first embodiment. That is, the amount by which stress is generated in the substrate covering resin layer 3 of the liquid jet head in this embodiment is smaller, by an amount equivalent to its overall volume reduction, than the amount by which stress is generated in the substrate covering resin layer 3 of the liquid jet head in the first embodiment. That is, not only can this embodiment reduce the amount by which stress is generated in the peripheral portion of the substrate covering resin layer 3 of the liquid jet head to prevent the substrate covering resin layer 3 from separating from the substrate 2, but also, can prevent the problem that the portions of the substrate covering resin layer 3, which surrounds its area having the ink passages 8, separate from the substrate 2.

The groove 9 is not located in the step portion 12. Therefore, the liquid jet head in this embodiment is satisfactorily strong in spite of the presence of the groove 9.

Embodiment 3

Figure 5:
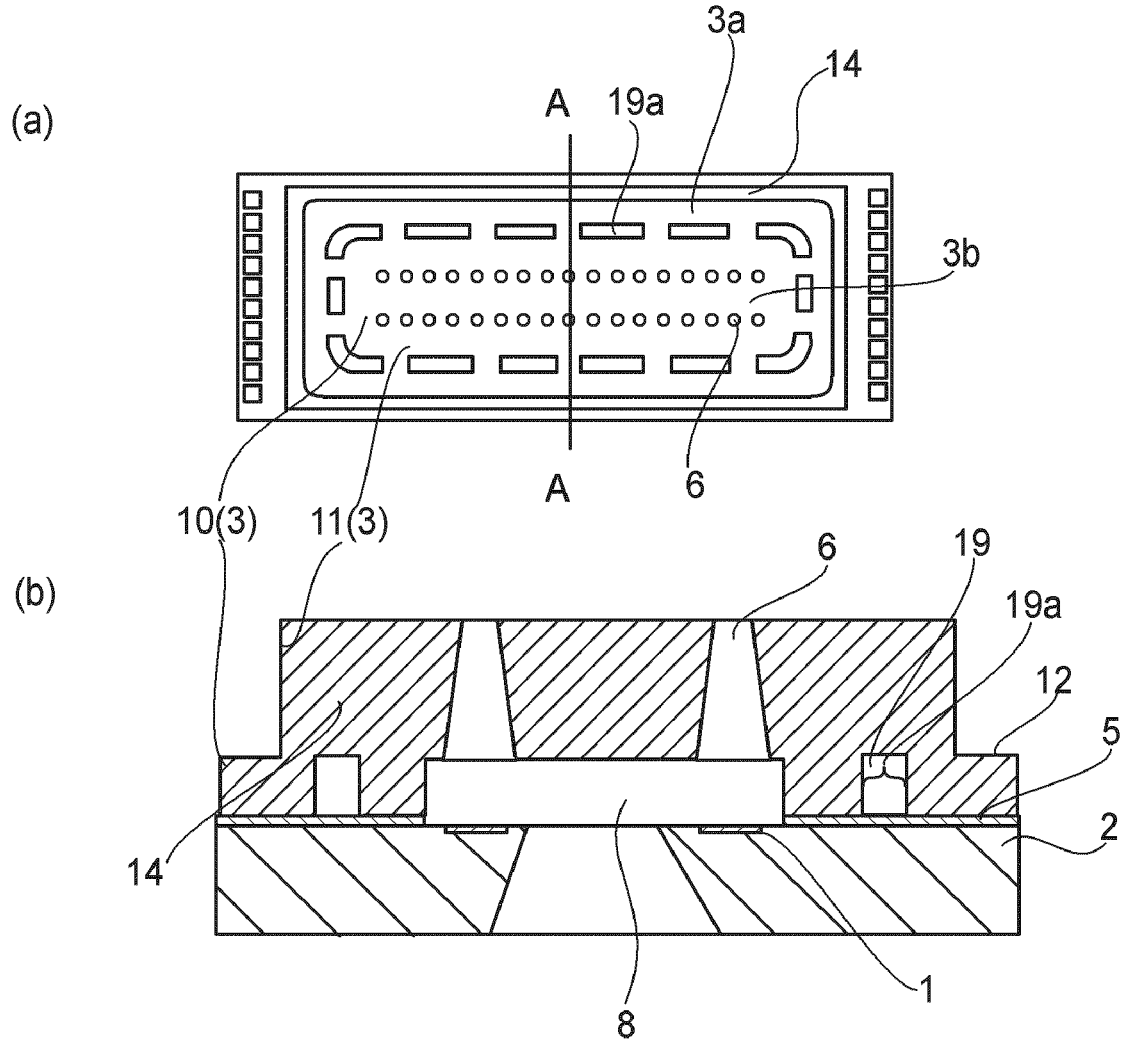
FIG. 5(*a*) is a plan view of the recording chip, which is a part of the liquid jet head in the third embodiment of the present invention, and FIG. 5(*b*) is a sectional view of the recording chip.
Figure 6:
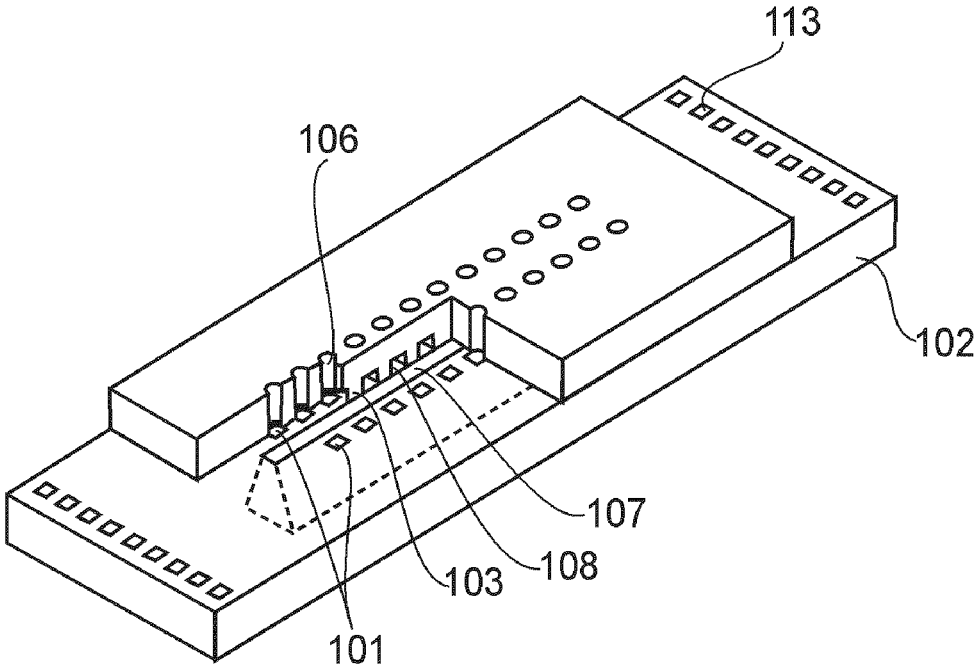
FIG. 6 is a schematic perspective view of an example of a typical conventional liquid jet head.

Next, the third preferred embodiment of the present invention will be described with reference to FIG. 5(*a*), which is a top plan view of the recording chip, that is, a part of the liquid jet head in this embodiment, and FIG. 5(*b*), which is a sectional view of the recording chip at a line A-A in FIG. 5(*a*).

Except that the liquid jet head in this embodiment is provided with a groove 19 and multiple connective portions 14, the liquid jet head in this embodiment is the same as that in the first embodiment. Thus, the features of the liquid jet head in this embodiment, which are the same as those of the liquid jet head in the first embodiment will not be described in detail. Further, the structural components of the liquid jet head in this embodiment, which are the same as the counterparts in the first embodiment, will be given the same referential codes as those given to the counterparts in the first embodiment, one for one, instead of directly describing them.

The liquid jet head in this embodiment is provided with a groove 19, which surrounds the portion of the substrate covering resin layer 3, which has the liquid ejection outlets 6 and ink passages 8. The groove 19 in this embodiment is different from that in the second embodiment in that the surface 19*a* of each of the lateral walls of the groove 19 in this embodiment is flat. Further, the portion 3*a* of the substrate covering resin layer 3, which is on the outward side of the groove 19, is connected to the portion 3*b* of the substrate covering resin layer 3, which is on the inward side of the groove 19, by the multiple connective portions 14, each of which are separated from adjacent ones by a preset distance.

In this embodiment, the internal surfaces 19*a* are flat. Therefore, the effects provided by the first embodiment, that is, the effects obtained by the jagged surfaces 9*a*, the cross section of which at a plane parallel to the substrate 2 looks like the teeth portion of a saw, cannot be obtained. However, the portion 3*a* of the substrate covering resin layer 3, which is on the outward side of the groove 9, and the portion 3*b* of the substrate covering resin layer 3, which is on the inward side of the groove 9, are supported by the connective portions 14. Therefore, the separation of the substrate covering resin layer 3 can be prevented.

Further, the present invention may be embodied in the combination of the second and third preferred embodiments. That is, not only may the surface of each of the lateral walls of the abovementioned groove be made jagged, but also, the substrate covering resin layer 3 may be provided with multiple connective portions, which connect the portion 3*a* of the substrate covering resin layer 3, which is on the outward side of the groove, and the portion 3*b* of the substrate covering resin layer 3, which is on the inward side of the groove.

Incidentally, the numerical values or the like quoted in the description of the preceding preferred embodiment are nothing but examples. That is, these values are not intended to limit the present invention in scope.

Next, a typical method for manufacturing the liquid jet head in this embodiment will be described.

Figure 8:
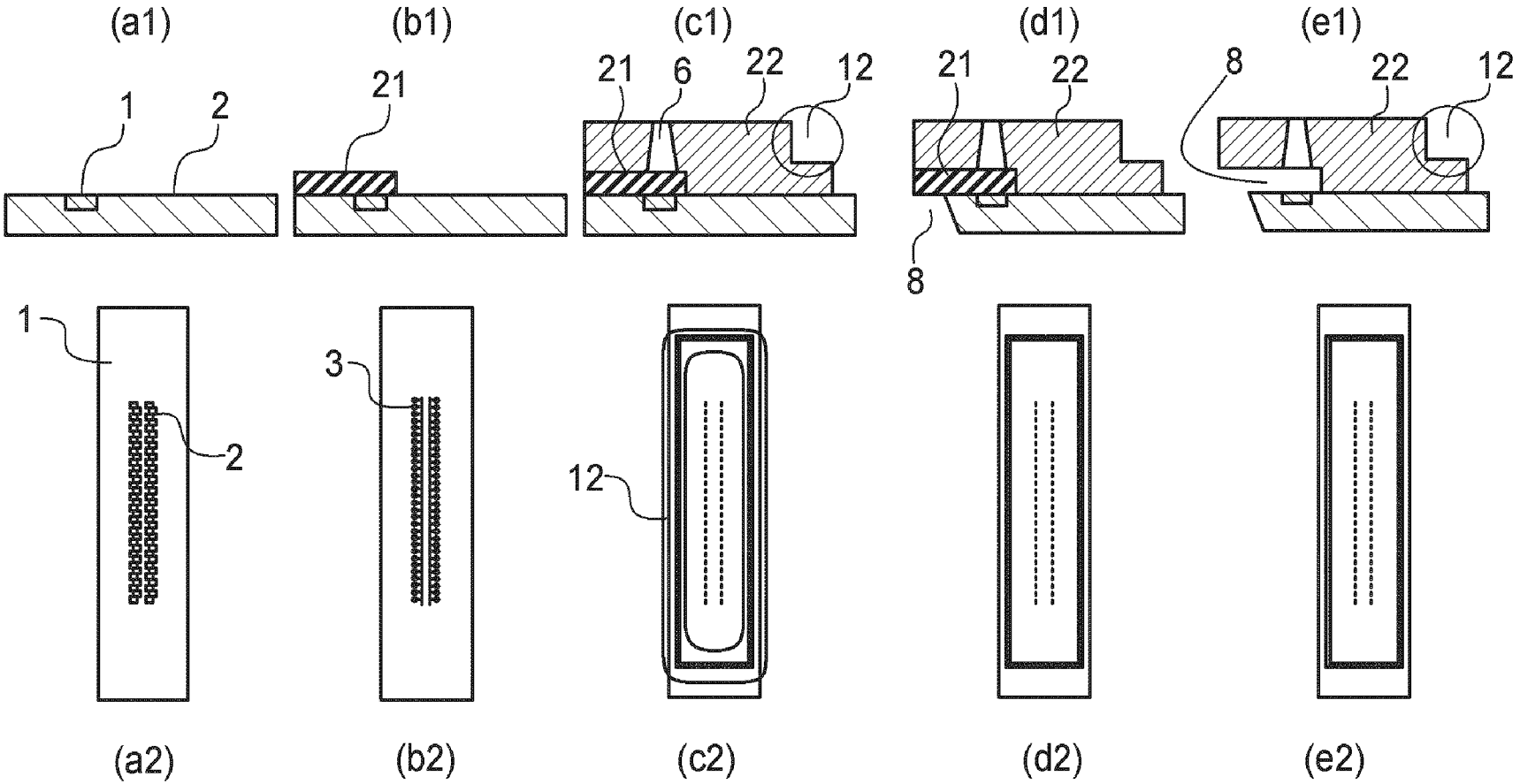
FIGS. 8(*a*1)-8(*e*1) are schematic sectional views of the recording chip, in various stages of its manufacture, one for one, for describing a typical method for manufacturing the liquid jet head in accordance with the present invention, and FIGS. 8(*a*2)-8(*e*2) are schematic plan views of the recording chip, in various stages of its manufacture, one for one, also for describing the typical method for manufacturing the liquid jet head in accordance with the present invention.

First, referring to FIG. 8, an example of a method for manufacturing the liquid jet head in this embodiment will be roughly described.

Figure 7:
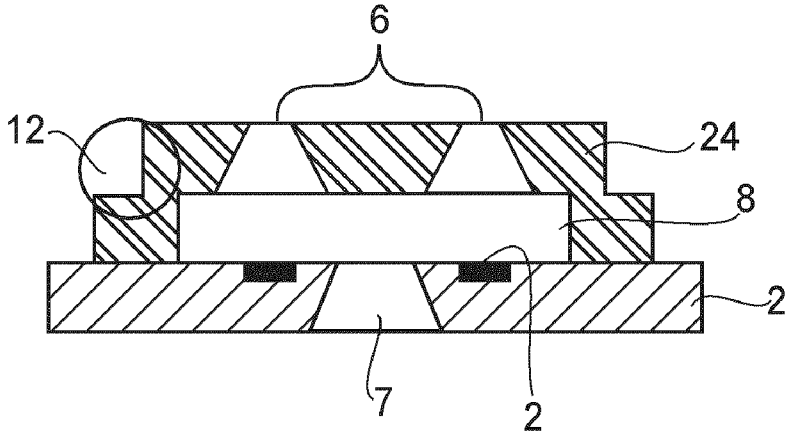
FIG. 7 is a schematic sectional view of an example of a liquid jet head in accordance with the present invention.

FIGS. 8(*a*1)-8(*e*1) are schematic sectional views of the precursors of the liquid jet head in the various stages of the manufacturing of the liquid jet head in this embodiment, as seen at a plane equivalent to the sectional plane in FIG. 7. FIG. 8(*a*2)-8(*e*2) are top plan views of the same precursors as those shown in FIGS. 8(*a*1)-8(*e*1), one for one.

First, energy generating elements 1 are formed on a substrate 2 as shown in FIGS. 8(*a*1) and 8(*a*2).

Next, a pattern 21 for the formation of the liquid passages is formed of dissolvable resin. More concretely, a sheet of dry film of resist is laminated on the surface of the substrate 2, or the top surface of the substrate is coated with resist by spin-coating or the like method. Then, the resist layer is exposed with ultraviolet rays (Deep-UV light), and developed. As the material for the resist, polymethyl isopropenyl ketone (ODUR-1010: product of Tokyo Ohka Kogyo Co., Ltd.) can be listed. Incidentally, if necessary, an adhesion improvement layer may be formed on the substrate before the formation of the pattern 21, in order to better adhere the liquid passage formation plate to the substrate 2. As the material for the adhesion improvement layer, polyether amide can be listed, for example.

Next, a cover layer 22, which is for forming the liquid passage formation plate, is formed on the pattern 21. Then, liquid ejection outlets 6 are formed through the cover layer 22, obtaining the precursor shown in FIGS. 8(*c*1) and 8(*c*2). It is in this step that the step portion 12 is formed in a manner to surround the primary portion of the cover layer 22. From the standpoint of reducing the amount by which stress is generated in the substrate covering resin layer 3, the step portion 12 is formed in such a manner to entirely surround the primary portion of the cover layer 22.

Next, referring to FIGS. 8(*d*1) and 8(*d*2), the liquid distribution hole 7 is formed through the substrate 2 by etching or the like method. More specifically, in a case where a silicon wafer is used as the material for the substrate 2, the ink distribution hole 7 is formed by anisotropic etching, with the use of strong alkaline solution, such as KOH, NaOH, and TMAH. More concretely, the bottom surface of the substrate (silicon wafer) is thermally oxidized, and the pattern for the liquid distribution hole 7 is formed on the oxidized bottom surface of the substrate 2. Then, the substrate 2 is etched with TMH solution for ten hours plus several hours, while keeping the temperature of the TMH solution at 80° to form the ink distribution hole 7.

Next, referring to FIGS. 8(*e*1) and 8(*e*2), the pattern 21 is removed to form the liquid passages 8. More concretely, the pattern 21 is exposed in entirety with Deep-UV light through the cover layer 22, and then, is dissolved away. Then, the remainder is dried. Incidentally, subjecting the precursor to ultrasonic waves while dissolving the pattern 21 can definitely reduce the time necessary for dissolving away the pattern 21.

After the completion of the above described steps, the precursor is provided with electrical contacts necessary for electrical connection. This is the last step in the manufacturing of the liquid jet head in this embodiment.

Next, the step shown in FIGS. 8(*b*1) and 8(*b*2), and the step shown in FIGS. 8(*c*) and 8(*c*2), that is, the steps for forming the step portion 12 will be described in detail with reference to FIG. 9.

Figure 9:
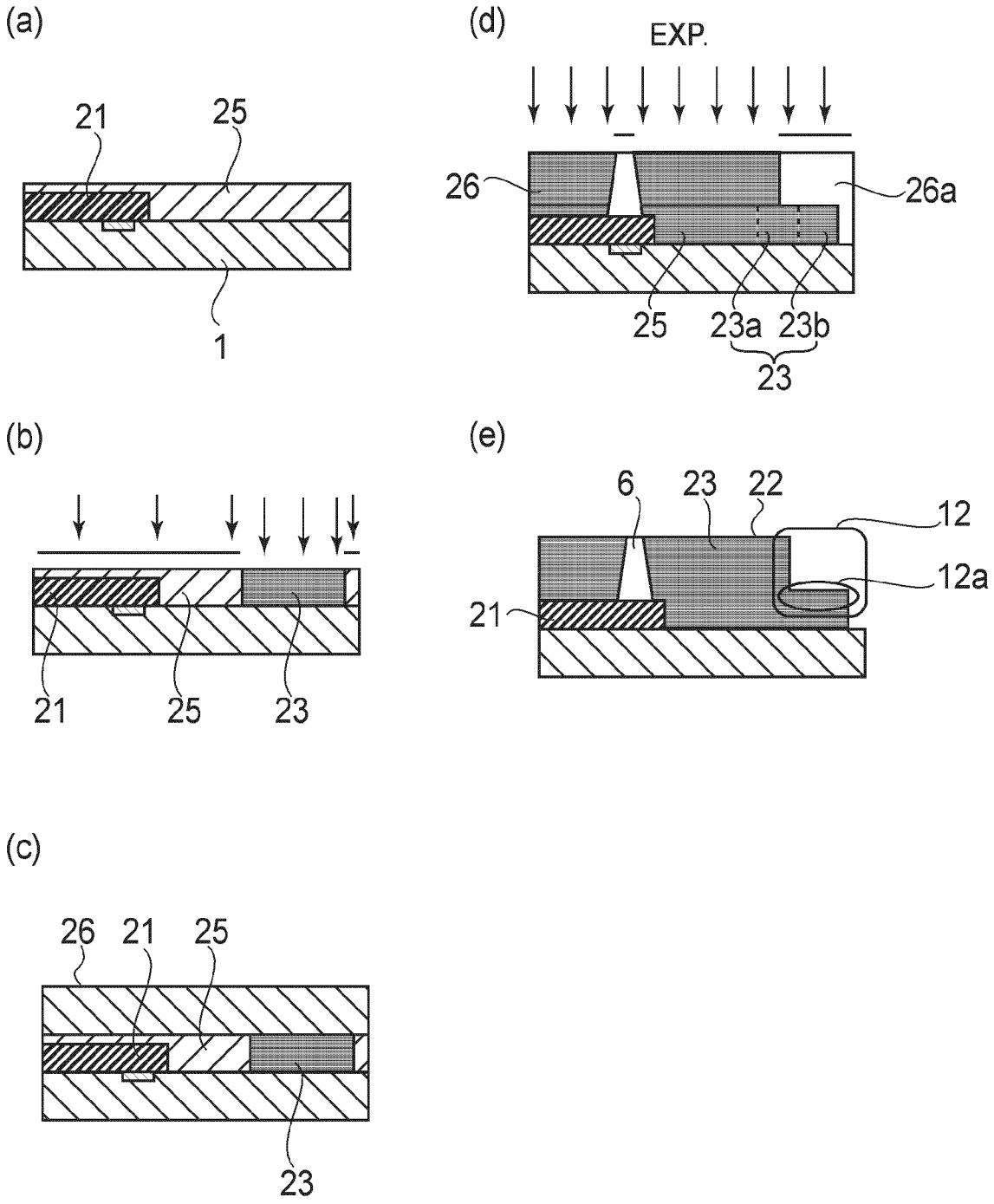
FIGS. 9(*a*)-9(*e*) are also schematic sectional views of the recording chip, in various stages of its manufacture, one for one, for describing the typical method for manufacturing the liquid jet head in accordance with the present invention.

FIG. 9 is a sectional view of the precursor of the liquid jet head in this embodiment, which is equivalent to the precursor shown in FIG. 8(*a*1).

Referring to FIG. 9(*a*), in order to form a liquid passage formation plate 24 on the pattern 21 on the substrate, a first cover layer 25, which is the bottom portion of the cover layer 22, is formed in a manner to cover the pattern 21 and the substrate 2. More specifically, the first cover layer 25 is formed by spin-coating the pattern 21 and the top surface of the substrate 2 with photosensitive resinous compound of the negative type. The photosensitive resinous compound used in this embodiment contains polymeric resin and polymerization initiator. As the polymeric resins usable as the material for the first cover layer 25 in this embodiment, there are resins obtainable by radical polymerization, resins obtainable by cationic polymerization, resins obtainable by anionic polymerization, and the like. There is no requirement regarding the choice of the polymeric resin. As for the initiator, in the case of a resin obtainable by cationic polymerization, a cation polymerization initiator is appropriate. As the cationic polymerization initiator, a substance which generates acid as it is exposed to light can be used. As the substance which generates acid as it is exposed to light, aromatic sulfonate or aromatic iodonium salt can be used. The abovementioned resin and initiator can be used by dissolving them in an appropriate solvent. Sometimes, an additive or additives may be added to form a liquid jet head which is superior in various properties, such as, mechanical strength. In particular, a photosensitive resin of the negative type, the polymeric resin of which is an epoxy resin, and the initiator of which is a substance which generates acid as it is exposed to light, is desirable as the material usable for the photolithography used for the formation of a liquid jet head in accordance with the present invention.

Figure 10:
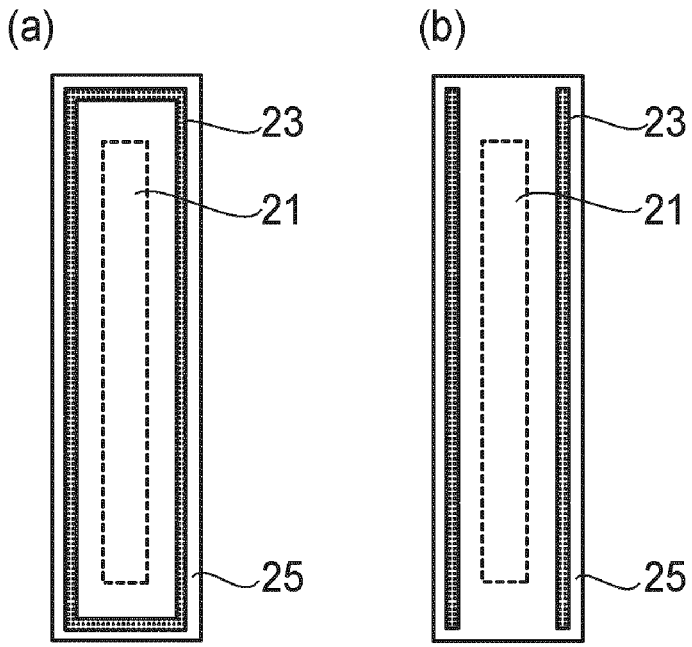
FIGS. 10(*a*) and 10(*b*) are schematic drawings of a couple of examples of a liquid jet head in accordance with the present invention.

Next, referring to FIG. 9(*b*), a part of the first cover layer 25 is exposed with ultraviolet rays or the like. As the part of the first cover layer 25 is exposed, the acid generating substance in the exposed part reacts to light acid, producing acid in the exposed portion. More specifically, at least the area of the first cover layer 25, which is on the outward side of the pattern, and the area of the first cover layer 25, which is not in the adjacencies of the pattern, are exposed, as shown in FIG. 10 (which is top plan view of precursor, which are equivalent to FIGS. 8(*a*2)-8(*e*2)). The area of the first cover layer 25, which is on the outward side of the pattern, is exposed. As a result, an exposed portion 23 is formed. Referring to FIG. 10(*a*), the exposed portion 23 is formed in a manner to surround the pattern 21 like a frame. However, the area of the first cover layer 25, which is on the outward side of the pattern 21, may be exposed in such a manner that the exposed portion 23 will result on each side of the pattern 21 as shown in FIG. 10(*b*).

Next, referring to FIG. 9(*c*), the second cover layer 26 for forming the liquid passage plate is formed on the first cover layer 25. The second cover layer 26 is formed also on the exposed portion 23. The material for the second cover layer 26, which is to be formed on the first cover layer 1 can be selected from among the aforementioned photosensitive resin of the negative type. However, the polymerization initiator for the material for the second cover layer 26 is desired to be the same as that for the material for the first cover layer 25. Further it is desired that the base resin for the material for the second cover layer 26 and the polymerization initiator for the material for the second cover layer 26 are the same as those for the material for the first cover layer 25. In particular, it is desired that the two photosensitive resinous compounds of the negative type are the same in the chemical compound seed. Although it is desired that the two materials are the same in chemical compound seed, it is not necessary that the two are the same in the ratio of the chemical compound seed. Further, the two materials may be different in density, or the like, relative to the solvent for spin-coating.

Next, referring to FIG. 9(*d*), the portions of the surface of the second cover layer 25, which will be turned into the liquid ejection outlets 6, are masked. Then, the first cover layer 25 is exposed together with the second cover layer 26. More concretely, the portions of the first cover layer 25, which are on the pattern 21, are exposed from above (through) the portion 23*a* (portions closer to pattern 21) of the exposed portion 23 of the second cover layer 26 formed on the exposed portions. Then, the portions of the first cover layer 25, which are below the part of the exposed part 23 of the first cover layer 25, is exposed through the portion of the second cover layer 26, which is above the pattern 21. As for the first cover layer 25, the exposed portion 23 to the area on the pattern 21 are exposed. The other portion 23*b* (portion away from pattern 21) of the exposed portion 23 is left unexposed portion 23 with the use of a mask. Then, the precursor is heated to harden the exposed portions of the first and second cover layers 25 and 26.

Next, the precursor is developed to remove the unexposed portions of the first and second cover layers 25 and 26, obtaining thereby the precursor, the cover layer 22 of which has the liquid ejection outlets 6 and the step portion 12 as shown in FIG. 9(*e*). The precursor shown in FIG. 9(*e*) is equivalent to the precursor of the liquid jet head in the first embodiment, which is shown in FIG. 8(*c*1).

Figure 11:
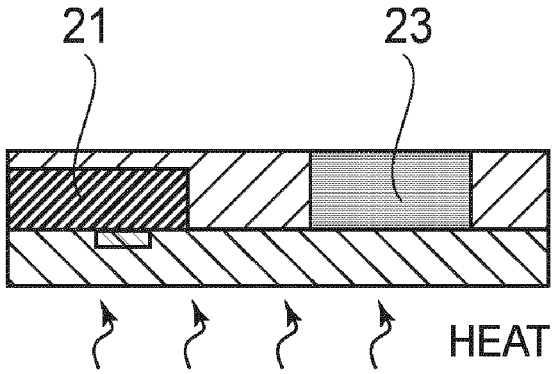
FIG. 11 is a schematic sectional view of a precursor of a liquid jet head in accordance with the present invention, for showing an example of a liquid jet head manufacturing method in accordance with the present invention.

It is preferable to harden the exposed portion 23 of the first cover layer 25 by heating the precursor, as shown in FIG. 11, after the completion of the steps described with reference to FIG. 9(*b*). The hardening of the exposed portion 23 prevents the acid from dispersing. That is, it can prevent the acid from moving from the exposed portion 23 into the second cover layer 26 as the second cover layer 26 is painted on the exposed portion 23 (FIG. 9 (*c*)). The exposed portion 23 has only to be heated to harden the exposed portion 23 enough to prevent the acid movement. As for the temperature level for the heating, it is thought that a temperature range of 80° C.-90° C. is appropriate, although it depends on the ingredients of the photosensitive resin of the negative type. The hardening of the exposed portion 23 can provide a distinct contrast between the portion 23*b* of the exposed portion 23, that is, the portion to be hardened, and the portion 11*a* of the second cover layer 26, which is on the portion 23*b* of the exposed portion 23, which is not to be hardened, respectively. Thus, the hardening ensures that the flange-like portion 12*a* of the step portion 12, which corresponds to the top surface of the exposed portion 23, is precisely formed in shape.

Further, described above is the case where the cover layer 10 is not developed after a portion of the first cover layer 25 is developed to create the exposed portion 23. The case where the cover layer 10 is developed after the hardening of the exposed portion 23 will be described later.

The steps which follow the step shown in FIG. 9(*b*) are the same as the steps shown in FIGS. 8(*d*1) and 8(*d*2).

In a case where the first and second cover layers 25 and 26 are created by painting, it is not necessary that each cover layer is created by a single stroke of painting means. That is, they may be exposed after they are created by applying the material for each cover layer several times.

Going through the above described steps when manufacturing the liquid jet head in this embodiment ensures that the resultant liquid jet head will have even more precisely formed step portion (flange-like portion) around its liquid passage plate, and therefore, the liquid passage plate does not separated from the substrate, because the precisely formed step portion (flange-like portion) can reduce the amount of stress to which the liquid passage plate is subjected.

Figure 13:
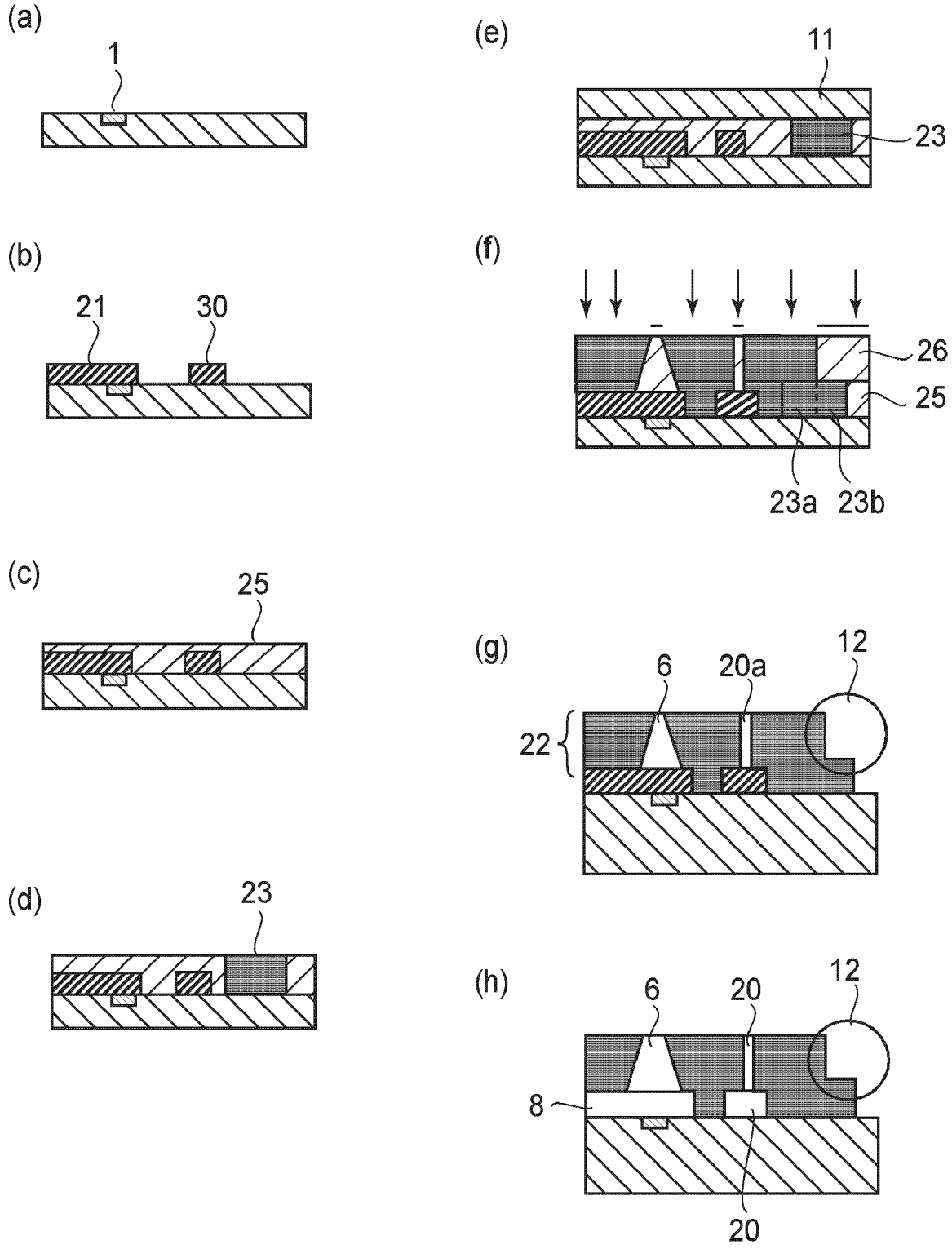
FIGS. 13(*a*)-13(*h*) are schematic sectional views of a precursor of the liquid jet head in accordance with the present invention, for showing another example of a liquid jet head manufacturing method in accordance with the present invention.

Next, referring to FIG. 13, the method for manufacturing the liquid jet head in another preferred embodiment will be described. FIGS. 13(*a*)-13(*h*) are schematic sectional views of the precursors of the liquid jet head, in this embodiment, which are in various manufacturing steps for the head, one for one, as are the FIGS. 8(*a*1)-8(*e*1).

First, referring to FIG. 13(*a*), energy generating elements 1 are formed on a substrate 2.

Next, referring to FIG. 13(*b*), a first pattern 21 for liquid passages and a second pattern 30 for forming a moat-like portion are formed on the substrate 2. The provision of the second pattern 30 causes the material for the first cover layer 25 to better fill the corner portion between the vertical edge of the first pattern 21 and the substrate 2. The second pattern 30 is formed in a manner to surround the first pattern 21.

Next, referring to FIG. 13(*c*), the photosensitive resin compound of the negative type is applied to the top side of the substrate 2 to form a first cover layer 25 in a manner to cover both patterns 21 and 30.

Next, referring to FIG. 13(*d*), the first cover layer 25 is exposed in such a manner that the resultant exposed portion 23 will surround the first and second patterns 21 and 30.

Next, referring to FIG. 13(*e*), the second cover layer 26 is formed on the first cover layer 25 to form a liquid passage plate. The material for the second cover layer 26 may be selected from among the abovementioned photosensitive resin compounds of the negative type.

Next, referring to FIG. 13(*f*), the portions of the second cover layer 26, which will become the liquid ejection outlets 6, and the portions of the second cover layer 26, which corresponds in position to the moat-like portion, are masked. Then, the first cover layer 25 is exposed together with the second cover layer 26. During this exposing step, the second cover layer 26 is exposed across the portion which corresponds in position to a portion 23*a* (portion away from pattern 21), and the portion which corresponds in position to the exposed portion 21, leaving exposed the portion which corresponds in position to the other portion 23*b* (portion closer to pattern 21), with the use of a mask. Then, the precursor is heated to harden the exposed portions of the first and second cover layers 25 and 26 to obtain a cover layer 22, which is an integration of the first and second cover layers 25 and 26.

Next, referring to FIG. 13(*g*), the liquid passages 8 and moat-like portion 20 are formed by removing the first and second patterns 21 and 30.

Figure 15:
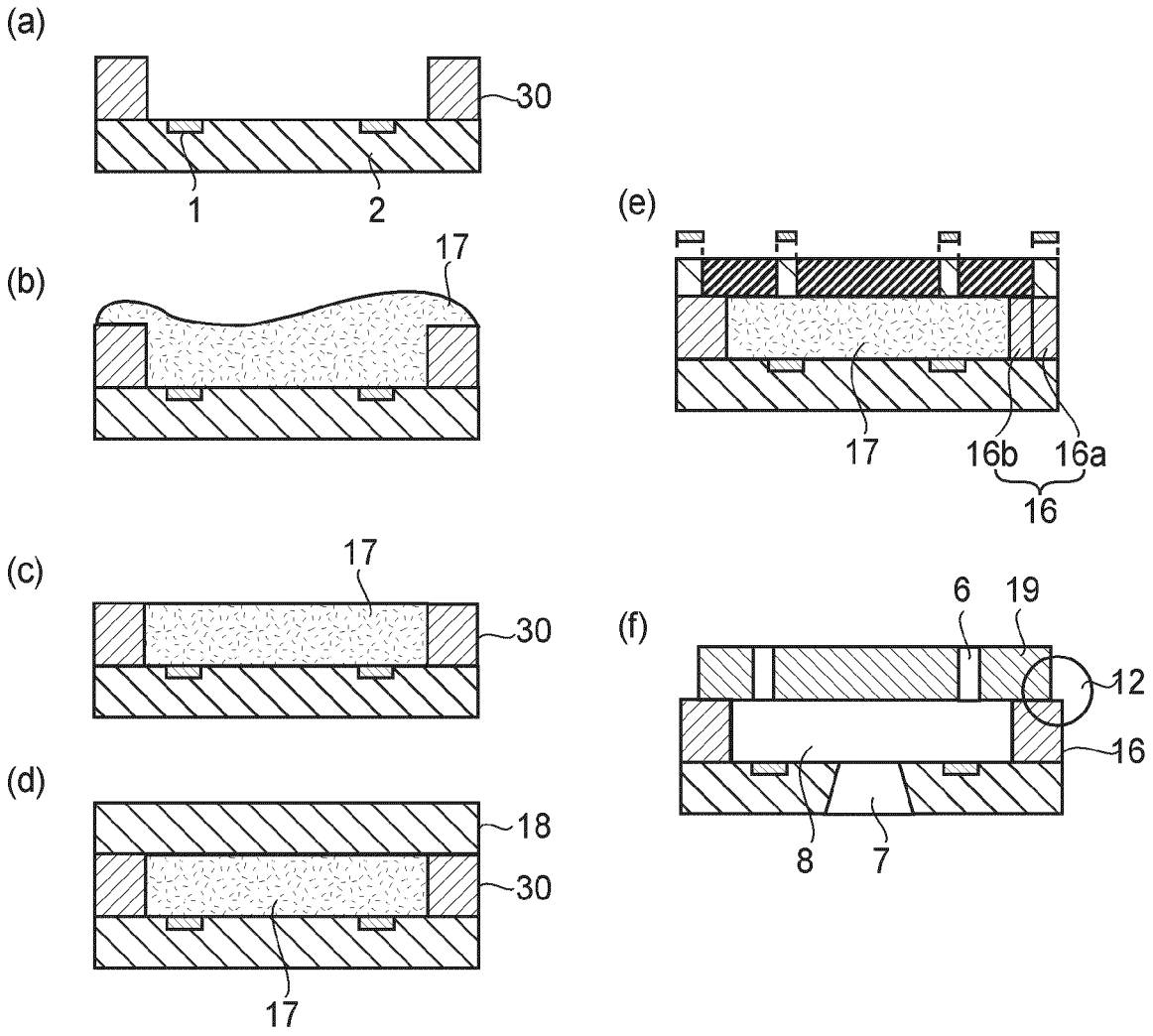
FIGS. 15(*a*)-15(*f*) are schematic sectional views of a precursor of the liquid jet head in accordance with the present invention, for showing another example of a liquid jet head manufacturing method in accordance with the present invention.

Next, referring to FIG. 15, the method for manufacturing the liquid jet head in another preferred embodiment of the present invention will be described. FIGS. 15(*a*)-15(*f*) are sectional views of the precursors of the liquid jet head, in this embodiment, which are similar to FIGS. 9(*a*)-9(*e*).

Referring to FIG. 15(*a*), lateral wall forming members 30 for forming the lateral walls of the liquid passages are formed on the substrate 2, on which energy generating elements have been formed. The lateral wall forming members 30 are formed by hardening the patterned photosensitive resin compound of the negative type.

Next, referring to FIG. 15(*b*), the space between the lateral wall forming members 30, which will become the liquid passages, is filled with dissolvable resin. More specifically, the dissolvable resin is poured into the space by the amount large enough to cover even the top surface of the lateral wall forming wall 30. Then, the dissolvable resin is hardened to form a solid dissolvable resin layer 17.

Next, the solid layer 17 is filed until the top surface of the lateral wall forming member 30 is exposed, that is, until the top surface of the lateral wall forming member 30 becomes level with the top surface of the filed solid layer 17, as shown in FIG. 15(*c*). As the method for filing (polishing) the solidified dissolved resin layer 17, it is possible to use one of the CMP (chemical-and-mechanical polishing) methods, for example.

Next, referring to FIG. 15(*d*), the material for a cover layer 18 is coated across the combination of the top surface of the lateral wall forming member 30 and the top surface of the solidified dissolvable resin layer 17. The material for the cover layer 18 is a photosensitive resin compound of the negative type. It is desired to be the same as the material for the lateral wall forming member 30. The examples of the photosensitive resin compound of the negative type for the cover layer 18 are the same as those mentioned as the examples of the material for the first cover layer 25.

Next, referring to FIG. 15(*e*), the portions of the cover layer 18, which will become the liquid ejection outlets 6 are masked, and also, the outward edge portion of the cover layer 18, which corresponds in position to the outward edge portion 30*b* of the lateral wall forming member 30, is masked. Then, the cover layer 18 is exposed. In other words, the cover layer 18 is exposed except for the portions which correspond in position to the liquid ejection outlets 6 and the outward edge portion 30*b* of the lateral wall forming member 30.

Next, the exposed cover layer 18 is hardened by the application of heat, and then, is developed. Then, the liquid distribution hole 7 is formed, and the solidified dissolvable layer 17 is removed. It is through this step that the liquid ejection outlets 16 are formed, and the outward edge portion of the lateral wall forming member 30 is removed in a manner to create a step between the lateral wall forming member 30 and liquid ejection outlet forming member 19.

At this time, another method for forming a structural component having a step, using the above described method, will be described referring to FIGS. 14(*a*)-14(*e*).

Figure 14:
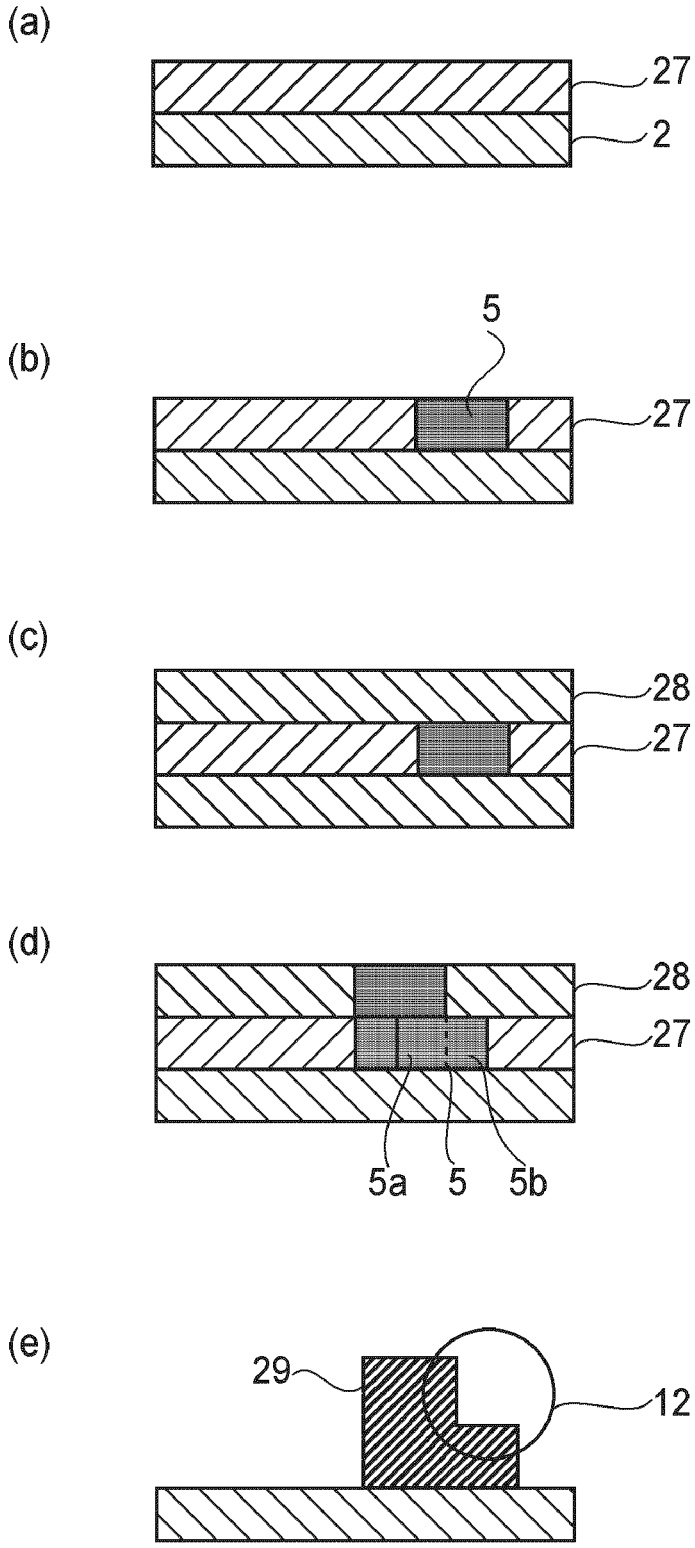
FIGS. 14(*a*)-14(*e*) are schematic sectional views of a precursor of the liquid jet head in accordance with the present invention, for showing another example of a liquid jet head manufacturing method in accordance with the present invention.

First, referring to FIG. 14(*a*), a first layer 27 is formed of a photosensitive resin compound of the negative type, on the substrate 2. As the photosensitive resin compound of the negative type for the first layer 27, one of those described as the examples of the photosensitive resin compounds of the negative type, which can be used as the material for the cover layers, can be used.

Next, referring to FIG. 14(*b*), the portions of the first layer 27 are selectively exposed to form an exposed portion 23. Then, the first layer 27 is heated to harden the exposed portion 23 to prevent the polymerization initiation seeds from dispersing.

Next, referring to FIG. 14(*c*), a second layer 28 is formed of a photosensitive resin compound of the negative type, on the first layer 27 in such a manner as to cover the exposed portion 23 as well. It is desired that the second layer 28 is the same in composition as the first layer 27.

Next, the second layer 28 and first layer 27 are partially exposed so that a portion 23*a* of the exposed portion 23 of the first layer 27 is exposed. More specifically, the portion of the second layer 28, which corresponds in position to the unexposed portion of the first layer is exposed from above the portion 23*a*. As for the first layer 27, the portion, which was not exposed in the preceding exposing step, is exposed. In this step, the portion of the second layer 28, which is above the other portion 23*b* of the exposed portion 23, is left unexposed. Then the exposed portions of the first and second layers 27 and 28 are hardened by the application of heat.

Next, the precursor was developed to remove the unexposed portions of the first and second layers 27 and 28, obtaining thereby a structure 29 having a step portion 12.

Next, an embodiment of the present invention, which is related to a method for manufacturing a liquid jet head in accordance with the present invention, will be concretely described.

Embodiment 6

First, a substrate 2, which is a piece of wafer made of silicon crystal with a crystal axis of 100 is masked (unshown) across the portion which corresponds in position to the ink distribution hole. Then, electro-thermal transducers 2 are formed, as energy generating elements, on the substrate 2. Then, a protective layer and a cavitation prevention layer (unshown) are formed (FIG. 8(*a*)). Each of the electro-thermal transducers is in connection to a control signal input electrode (unshown) for activating the element.

Next, a liquid passage pattern 21 is formed of positive resist formed of acrylic resin (ODUR1010A: product of Tokyo Ohka Kogyo Co., Ltd.), on the substrate 2 (FIG. 8(*b*1)). Then, the following compound A is spin-coated on the pattern 21, and the precursor is baked for nine minutes at 90° C., to form the first cover layer 25, which is 20 μm in thickness (FIG. 9(*a*)).

| (Compound A) | |
|---|---|
| Epoxy resin: EHPE3150 (Daicel Chemical Industry Ltd.) | 94 parts by weight |
| Silane coupling agent: A-187 (Nippon Unicar (Co., Ltd)) | 4 parts by weight |
| Optical acid generating agent: SP-172 (Adeka Corp.) | 2 parts by weight |
| Solvent: xylene | |

Next, the portion 23 of the first cover layer 25 is partially exposed at a 120 mJ/cm$^2$ (FIG. 9(*b*)). Then, the precursor was heated three minutes at 90° C.

Then, the second layer 26, which is 60 μm in thickness, was formed on the first cover layer 25 by coating the compound A on the first cover layer 25 (FIG. 9(*c*)).

Next, the first and second cover layers 25 and 26 were exposed at 50 mJ/cm$^2$. More specifically, the exposed portion 23 was exposed in such a pattern that the portion 23*a* was exposed while leaving the portion 23*b* unexposed (FIG. 9(*d*)).

Then, the precursor was developed with xylene to form the liquid ejection outlets 6 and the step portion 12*a* (flange-like portion) (FIG. 9(*e*)).

Next, the liquid distribution hole 7 was formed, and the pattern 21 was removed, to complete the liquid passage formation plate (FIG. 8(*e*1)).

The liquid jet head in accordance with the present invention was obtained through the above described steps.

Embodiment 5

This embodiment of the present invention, which is related to the manufacturing of a liquid jet head in accordance with the present invention, is the same as the fourth embodiment, except that in this embodiment, the precursor was not baked after the exposure of the portion 23 in FIG. 9(*b*).

Embodiment 6

Up to the step shown in FIG. 9(*b*), this embodiment is the same as the fourth embodiment.

Then, the first cover layer 25 was heated to harden the exposed portion 23. Then, the precursor was developed to remove the portions of the first cover layer 25 other than the exposed portion 23, obtaining the precursor shown in FIG. 12(*a*).

Figure 12:
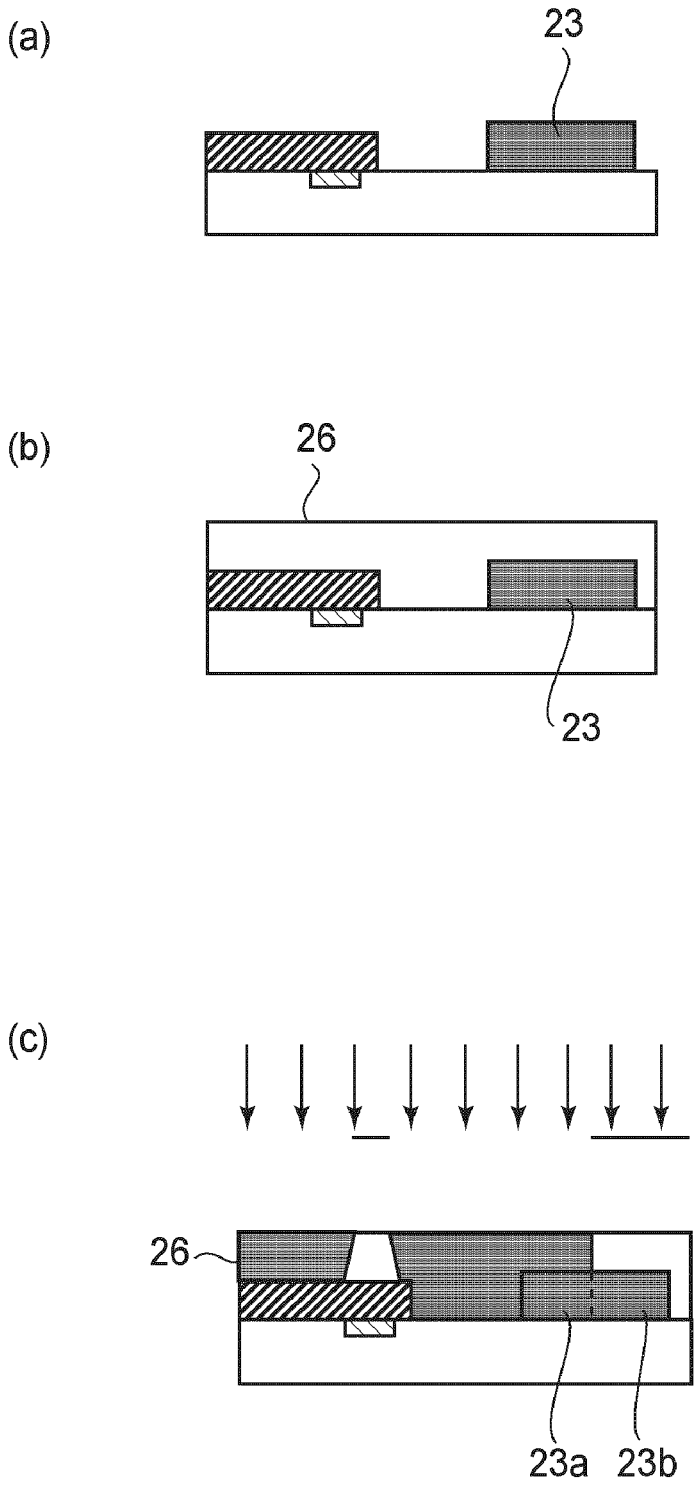
FIGS. 12(*a*)-12(*c*) are schematic sectional views of a precursor of the liquid jet head in accordance with the present invention, for showing another example of a liquid jet head manufacturing method in accordance with the present invention.

Next, the second cover layer 26 was formed in a manner to cover the exposed portion 23 (FIG. 12(*b*)).

Then, the first and second cover layers 25 and 26 were exposed so that the portion 23*a* of the exposed portion 23 was exposed while the portion 23*b* remains unexposed.

The steps which were carried out hereafter to obtain a liquid jet head in accordance with the present invention, were the same as those in the fourth embodiment, which were described with reference to FIG. 9(*e*).

Comparative Example 1

Figure 16:
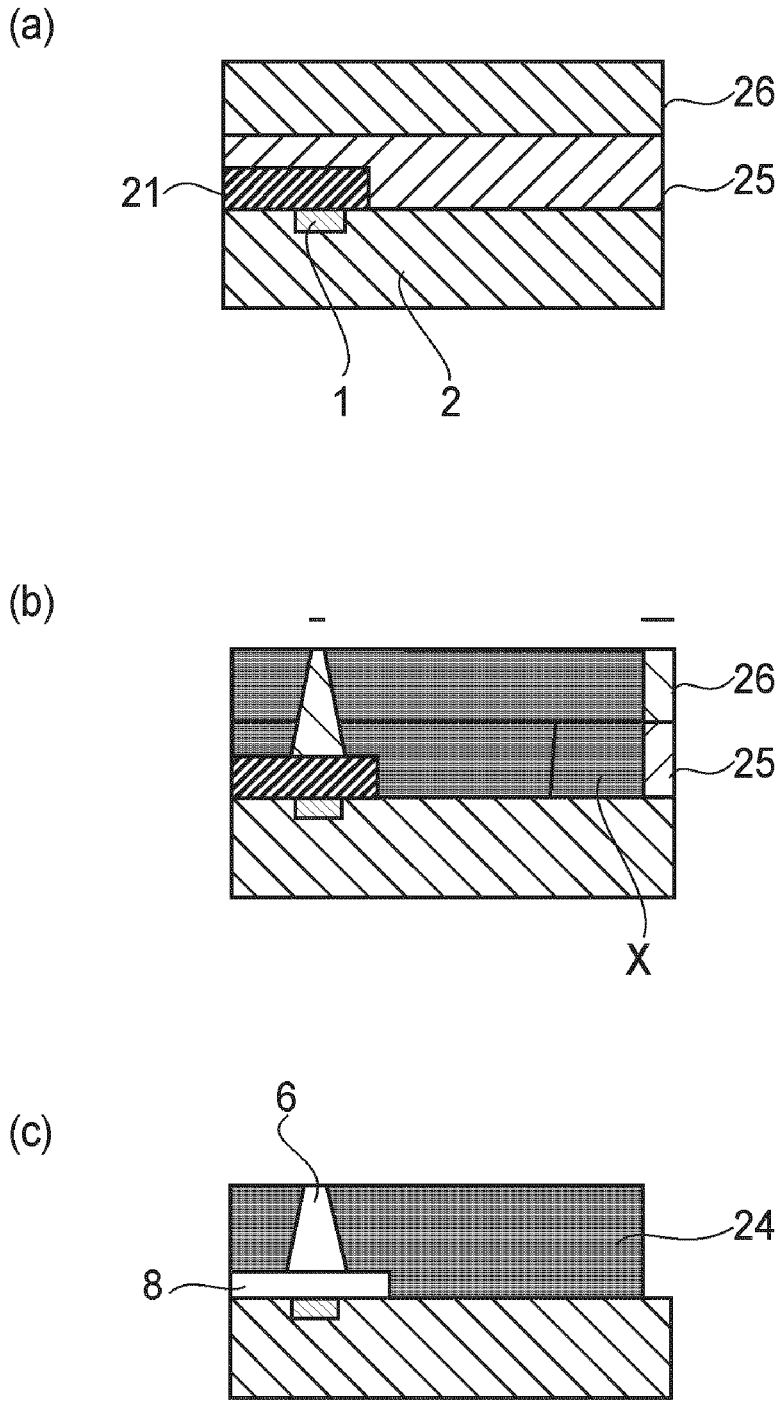
FIGS. 16(*a*)-16(*c*) are schematic sectional views of a precursor of the liquid jet head in accordance with the present invention, for showing another example of a liquid jet head manufacturing method in accordance with the present invention.

Next, referring to FIG. 16, the method for manufacturing a comparative liquid jet head will be described. FIGS. 16(*a*)-16(*c*) are sectional views of a conventional liquid jet head (comparative liquid jet head), which are equivalent to FIGS. 8(*a*1)-8(*e*1).

This liquid jet head manufacturing method is the same as the liquid jet head manufacturing method in the fourth embodiment up to its step which is the same as the step in fourth embodiment, shown in FIG. 9(*b*).

Then, the second cover layer 26 is formed on the first cover layer 25 without exposing the first cover layer 25, obtaining the precursor shown in FIG. 9(*a*) The method used for forming the second cover layer 26 is this embodiment is the same as that used in fourth embodiment. The first and second layers of this conventional liquid jet head are the same in thickness as the counterparts of the liquid jet head in the fourth embodiment.

Next, the first and second cover layers 25 and 26 were exposed at 500 mJ/cm$^2$ (FIG. 16(*b*)). The portion X of the first cover layer 25 of this liquid jet head, which is shown in FIG. 16(*b*), and is the outward end portion of the first cover layer 25, is comparable to the exposed portion 23*a* in the fourth embodiment.

The steps which were carried out thereafter to obtain the conventional liquid jet head shown in FIG. 16(*c*) were the same as those carried in fourth embodiment. The comparative example of a liquid jet head, that is, the liquid jet head manufactured through this method for manufacturing a liquid jet head does not have the step portion 12*a* (flange-like portion).

(Evaluation)

The liquid jet head in the first to third preferred embodiments, and the liquid jet head made with the use of the comparative example 1 of a liquid jet head were subjected to pressure-temperature tests.

A certain number of each of the liquid jet heads in the first to third preferred embodiments of the present invention, and the comparative example of a liquid jet head (conventional liquid jet head) were prepared, and were dipped in ink. Then, they are left under twice the normal pressure at 121° for ten hours. Then the liquid jet heads were examined to find if separation occurred between the substrate 2 and liquid passage formation plate of any of the liquid jet head.

In the case of the liquid jet heads in accordance with the present invention, virtually no separations were found between the liquid passage formation plate 24 and substrate 2. Further, even in the case of a liquid jet head whose liquid passage formation plate 24 and substrate 2 separated from each other, the extent of separation is at a level which is not problematic in practical terms.

On the other hand, in the case of the comparative liquid jet heads (conventional liquid jet heads), the ratio of the liquid jet heads whose liquid passage formation plate and substrate 2 had separated from each other was greater than in the case of the liquid jet heads in accordance with present invention. Further, the former was greater in the extent of separation than the latter.

It is reasonable to think, based on the above described result, that because the liquid jet heads in the above described preferred embodiments of the present invention were provided the step portion 12 (flange-like portion), the stress which occurs in the liquid passage formation plate 24, formed of the photosensitive resin of the negative type, that is, the material for the liquid passage formation plate 24, shrinks when it hardens, or the like stress, is reduced by the step portion 12 (flange-like portion).

Further, the flange-like portion 12*a* of the step portion 12 in the fourth preferred embodiment of the present invention, which corresponds in position to the top surface of the exposed portion 23 was flatter than the counterpart in the fifth preferred embodiment. It is reasonable to think that this occurred because in the case of the fourth embodiment, the exposed portion 23 is hardened by the application of heat after the formation of the exposed portion 23, and therefore, the exposed portion 23 remained intact in the shape of its top surface as it was formed as a part of the first cover layer. That is, it is reasonable to think that the hardening reduced the movement of the acid generated by the exposure, and therefore, in the case of the fourth embodiment, the acid did not disperse into the second cover layer 26 as much as it did in the case of the fifth embodiment.

Moreover, the surface of the liquid jet head in the fourth embodiment, which has the opening of each of the liquid ejection outlets 6, was flatter than the counterpart in the sixth embodiment. It is reasonable to think that this occurred because in the case of the liquid jet head in the fourth embodiment, the second cover layer 26 was formed on the first cover layer 25 without carrying out the developing process after the exposure of the portion 23, that is, while keeping flat the top surface of the first cover layer 25.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 016369/2008 and 244196/2008 filed Jan. 28, 2008 and Sep. 24, 2008, respectively, which are hereby incorporated by reference herein.

What is claimed is:

1. A liquid ejecting head comprising:

a coating resin layer including a plurality of ejection outlets for ejecting liquid and flow paths which are in fluid communication with the ejection outlets, respectively;

a substrate having energy generating elements for generating energy for ejecting the liquid; and an adhesion improving layer provided between said coating resin layer and said substrate, wherein said coating resin layer further includes a first resin material layer which is closest to said substrate and in which the flow paths are formed, and at least one second resin material layer in which the ejection outlets are formed, and said first resin material layer provides at least one stepped portion continuing from a periphery of said second resin material layer.

2. A liquid ejection head according to claim 1, wherein said stepped portion has a height from an interface between said adhesion improving layer and said coating resin layer to a surface of said stepped portion that is smaller than one half of a maximum thickness of said coating resin layer.

3. A liquid ejection head according to claim 1, wherein said second resin material layer has a corner portion in the form of a curved surface.

4. A liquid ejection head according to claim 1, wherein a corner portion of said first resin material layer is formed by crossing surfaces.

5. A liquid ejection head according to claim 1, wherein said second resin material layer is provided with a groove surrounding a flow path formation region constituted by the ejection outlets and the flow paths.

6. A liquid ejection head according to claim 5, wherein the groove includes an inner side having pits and projections.

7. A liquid ejection head according to claim 5, wherein the groove includes a flat inner side.

8. A liquid ejection head according to claim 5, further comprising a plurality of connecting portions connecting outer and inner sides of the groove.

9. A liquid ejecting head comprising:

an orifice plate including a plurality of ejection outlets for ejecting liquid and flow paths which are in fluid communication with the ejection outlets, respectively;

a substrate which is connected with said orifice plate and has energy generating elements for generating energy for ejecting the liquid; and a stepped portion provided at an outer periphery of said orifice plate, wherein the outer periphery of said orifice plate has a thickness not more than one half of a maximum thickness of said orifice plate.

* * * * *